United States Patent [19]

Pearlman

[11] 3,976,921

[45] Aug. 24, 1976

[54] TRIGGERING CIRCUIT

[76] Inventor: Edward D. Pearlman, 1442 2nd Ave., Apt. B, Oakland, Calif. 94606

[22] Filed: Jan. 27, 1975

[21] Appl. No.: 544,634

[52] U.S. Cl. ..... 317/135 R; 340/256

[51] Int. Cl.[2] ..... H01H 47/00

[58] Field of Search ..... 317/135; 340/253 B, 340/256, 274 R, 276, 409

[56] References Cited

UNITED STATES PATENTS

| | | | |
|---|---|---|---|
| 2,882,455 | 4/1959 | Ferguson, Jr. | 317/135 R |
| 3,611,362 | 10/1971 | Scott | 340/409 |
| 3,815,112 | 6/1974 | Kleber | 340/276 |

*Primary Examiner*—Donovan F. Duggan
*Assistant Examiner*—Harry E. Moose, Jr.
*Attorney, Agent, or Firm*—Theodore J. Bielen, Jr.; Richard Esty Peterson

[57] ABSTRACT

Circuit for triggering an electrical signal for actuation of an electrical mechanism. The circuit includes a switch means for producing an electrical pulse and a means for reversing the current flow upon receipt of such electrical pulse both connected in series. Direction of flow of the current indicates either a closed circuit or readiness for triggering an electrical signal upon a circuit break.

9 Claims, 2 Drawing Figures

TRIGGERING CIRCUIT

BACKGROUND OF THE INVENTION

The present invention relates to a circuit capable of producing a signal upon the opening or breaking of the circuit. This invention is particularly useful, although not limited to, activating alarms and the like to protect buildings, yards, and other enclosures.

The present state of the art contains alarm systems requiring a multiplicity of actuating circuits which are expensive and difficult to install and maintain. Such systems, also, are easily overcome by an intruder possessing rudimentary knowledge of the system; for example, merely cutting the circuit conductors often deactivates the alarm.

The cumbersomeness of prior systems precludes their alternation without significant cost and effort after the initial installation. In particular, there is a need for a circuit adaptable for use in triggering alarms and the like, that will permit the simple insertion of remote controls where desired. In the past, the labor required to install remote controls has been prohibitively expensive because of the inflexibility of alarm designs with respect to ever changing needs.

SUMMARY OF THE INVENTION

In accordance with the present invention, a circuit is provided having a source of power connected to means for reversing the direction of current flow such as a double-pole, double-throw pulse latching relay which arms the circuit when operated. The operation takes place when a switch, having a parallel resistor in series with the double-pole, double-throw relay, turns to the open position. Thus, the resistor is placed on the line in series with the other circuit components reducing the current flowing to a pair of unequally sensitive relays connected in parallel. One of these relays deactivates, causing the operation of the double-pole, double-throw relay which reverses current flow in the circuit. Subsequently turning of the switch to the closed position reactivates the deactivated relay.

The circuit may trigger an electrically operated mechanism such as an alarm, a mechanical device, another electrical circuit, or the like with a steady electrical output signal.

The circuit may also include a pair of parallel light-emitting diodes in series with the switch and resistor to indicate the presence and direction of current flow to the user of the circuit or, for example, that the circuit is ready to set off the alarm. Reseting means may also be included in the circuit, if so desired, to turn off the circuit.

It is, therefore, an object of the present invention to provide a circuit useable to produce an event upon the breaking of the circuit. This may be effected by the normally closed loop actuators placed in series with the components of the circuit. Open loop actuators may also be placed in the circuit by employing a relay means whose armature lies in series with the closed circuit elements.

It is another object of the present invention to provide a circuit useable with a burglar alarm for an enclosure that is tripped in the normal manner, such as opening a window, opening a door, stepping on a carpet sensor, intercepting a projected beam and the like.

It is a further object of the present invention to provide a circuit useable with an alarm system possessing flexibility which permits the installation of remote controls without the necessity of multiple circuits and the associated labor expense.

It is yet another object of the present invention to provide a circuit which utilizes a reversal in the direction of current flow to indicate the integrity of the circuit and the readiness in producing a signal to trigger a mechanism.

It is yet another object of the present invention to indicate the direction of flow of current in a circuit with light-emitting diodes.

A further object of the present invention is to provide a relatively simple and effectual alarm system containing a circuit which will indicate the readiness of the alarm and will trigger the alarm upon a break in the circuit.

The invention possesses other objects and advantages, especially as concerns particular features and characteristics thereof which will become apparent as the specification continues.

DESCRIPTION OF THE PREFERRED EMBODIMENT

Figure 1:
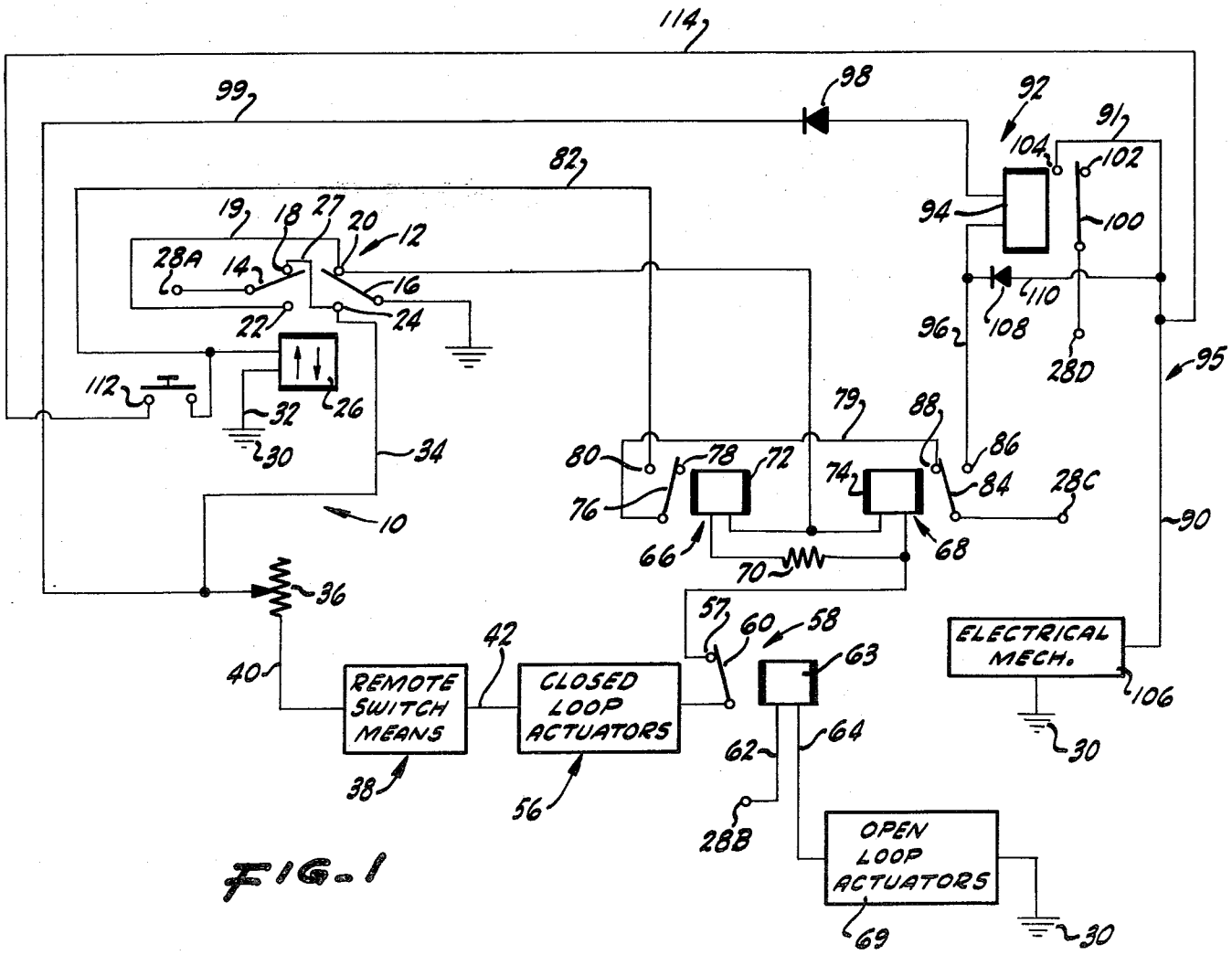
FIG. 1 is a schematic diagram illustrating an exemplary embodiment of the invention.

With reference to FIG. 1, the preferred embodiment of the triggering circuit as a whole is denoted by reference character 10. A means for reversing the current flow is preferably depicted as a double-pole, double-throw pulse latching relay 12 which has two armatures 14 and 16 which move in unison from contacts 18 and 20 to contacts 22 and 24 and vice versa upon the receipt of a pulse by coil 26. For example, the relay 12 may be of the type manufactured by Potter and Brumfield, Model No. PC11D. Contacts 18 and 24 connect via conductor 27. Armature 14 connects to a D.C. power source 28A which may take the form of any conventional battery or rectified A.C. power source. For convenience, power source 28 is shown connected to various circuit elements in FIG. 1, and will be described in greater detail, hereinafter. As such, A.C. or D.C. power sources of different values may be used in FIG. 1 to conform to the particular element therein, as is well known to one of ordinary skill in the art. Power source 28 is therefore distinguished by an accompanying letter, e.g. A, B, C, and D. Armature 14 moves between contact 18 and contact 22 which connects to contact 20 through conductor 19. Armature 16 runs to ground 30 and travels between contacts 20 and 24. Coil 26 has one lead to ground 30. Contact 24 connects to potentiometer 36 through circuit line 34. Potentiometer 36 adjusts the current through the elements found within the circuit which will be more fully described as the specification continues.

Figure 2:
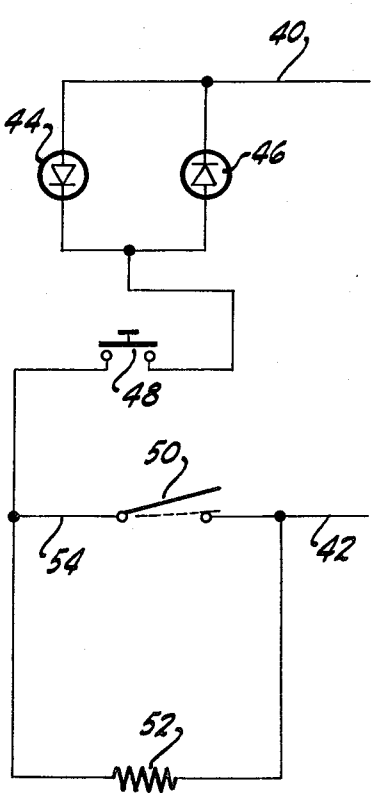
FIG. 2 is a schematic diagram of the remote switch means.

In series with potentiometer 36 is a remote switch means 38, most clearly shown in FIG. 2. Remote switch means 38 connects to potentiometer 36 by circuit conductor 40. It should be noted that a plurality of remote switch means 38 may be placed in series with potentiometer 36, but for the purposes of explanation, a single remote switch means will be described. In series with potentiometer 36 are a pair of parallel light emitting diodes 44 and 46 which may emit light of distinctive colors, such as green and red, respectively. As shown in FIG. 2, the current flow will only light one of the diodes 44 and 46 at a time since they are oppositely disposed. In other words, the current flow toward circuit line 40 will light the green diode 44 and current flowing from circuit line 40 will light the red diode 46. The lack of illumination of either diode 44 or 46 indicates circuit 10 is incomplete.

A conventional tamper switch 48 lies in series with the pair of diodes 44 and 46 to insure a break in the circuit in the case of an attempt to meddle with remote switch means 38.

Break switch 50, preferably key operated (but operable in any conventional manner, such as by a push button) in series with tamper switch 48, lies in parallel with a resistor 52. The switch 50 is spring-loaded to return to a closed position, as shown in phantom, but may be manually returnable and instantaneous or delayed in its return, as desired. Resistor 52, in parallel with switch 50, causes a reduction in the current flow in the circuit upon the opening of switch 50. The effect of resistor 52 will be more fully expostulated as the specification continues.

Closed loop actuators 56 may be placed in the circuit 10 at any point, but are shown in FIG. 1 as adjacent remote switch means 38. In the case of electrical mechanism 106 being an alarm, actuators 56 may take the form of trips that open the circuit 10 such as a window, door and the like, as is well known in the art.

Also in series is the armature 60 of open loop relay 58 which is typically of single-pole, single-throw construction. Lead line 62 of coil 63 connects to power source 28B and lead line 64 of coil 63 connects to an open loop actuator 69, for example a carpet trip and the like, which connects to ground 30.

A pair of parallel relays 66 and 68 are joined in series with armature 60. For example, the relays 66 and 68 may be single-pole, single-throw and single-pole, double-throw, respectively. Resistor 70 biases the current flow through the relays 66 and 68 such that less current passes through coil 72 than coil 74. The armature 76 of coil 72 travels between neutral point 78 and contact 80 which links with coil 26 of relay 12 via circuit line 82. Armature 84 of relay 68 connects to power source 28C and travels between contacts 86 and 88. Contact 88 connects to armature 76 of relay 66 and contact 86 connects to coil 94 of relay 92, as described hereinafter as electrical mechanism circuit 95.

As shown in FIG. 1, the electrical mechanism circuit 95 includes a single-pole, double-throw relay 92 having a coil 94 which connects to contact 86 by circuit line 96. The second lead-in to coil 94 connects to contact 24 of relay 12. Diode 98 prevents any stray current flow between coil 94 and relay 12, especially in the case of power source 28 being of unequal value to these elements, as heretofore described. Armature 100 connects to power source 28D and travels between neutral point 102 to contact 104. The electrical mechanism 106 connects to contact 104 via circuit line 90 and to ground 30.

Circuit line 110 links circuit lines 90 and 96 and diode 108 prevents the flow of current from line 90 to line 96.

Reset switch 112 spans line 82 and circuit line 114 which connects to circuit line 90.

In summary, circuit 10 includes the contacts 18, 20, 22 and 24 of relay 12, potentiometer 36, remote switch means 38, closed loop actuators 56, armature 60, coils 72 and 74, and associated circuit lines.

In operation, the closed loop actuators 56 and open loop actuators 69 will be initially closed and open respectively, and the armatures of relays 12, 58, 66, 68, and 92 will be in the positions shown in FIG. 1 (assuming the electrical mechanism is not activated). The current through the circuit 10 will flow from ground 30, armature 16 through the circuit 10 and to power source 28A connected to armature 14. For the sake of consistency in the specification, the current is assumed to flow from ground 30 to the positive terminals of the power sources 28. At this point, there is no voltage potential to the electrical mechanism 106 and relay 92.

The current flow in this direction illuminates diode 44, for example, with a green color. This signifies to the operator that the open and closed loop actuators are in the proper position to render the circuit complete.

The operator then turns the switch 50 to the open position placing resistor 52 in the circuit without the parallel circuit line 54. Thus, the current flow through the circuit 10 reduces in value while the switch 50 remains open. As previously discussed, the coils 72 and 74 of the relays 66 and 68 carry unequal electrical current. This effect may be produced by selecting relays 66 and 68 of unequal sensitivity or by biasing the current flow with a resistor 70, as shown in FIG. 1. In either case, the reduced current flow resulting from the opening of switch 50 causes the armature 76 of relay 66 to travel from contact 78 to contact 80 while holding armature 84 of relay 68 to contact 88. In other words, relay 66 "falls out" since the current flow through coil 72 is below operating level, while relay 68 continues to hold armature 84 to contact 88. Potentiometer 36 may be inserted in the circuit 10 to adjust the current flow to relays 66 and 68 such that the differential action described above upon the opening of switch 50 may be accurately predetermined. Potentiometer 36 also adjusts the current flow in circuit 10 according to the number of remote switch means 38 used within said circuit.

The movement of armature 76 pulses coil 26 in relay 12. Current flows from ground 30 through circuit line 32, coil 26, circuit line 82, armature 76, circuit line 79, armature 84 and the positive terminal of power source 28C. Thus, armatures 14 and 16 travel from contacts 18 and 20 to contacts 22 and 24. As a result, the current flow in circuit 10 reverses its direction illuminating diode 46, for example, with a red light which signifies that a subsequent break in the circuit 10 will activate electrical mechanism 106. Repositioning switch 50 to the closed position, returns armature 76 of relay 66 to contact 78. It should be noted that repositioning switch 50 has no effect on the direction of current flow since relay 12 latches with each pulse either at contacts 22 and 24 or 18 and 20.

At this point, the circuit 10 may trigger the electrical mechanism 106 simply by effecting a break in the circuit. The breaking of circuit 10 may occur at any point in the circuit in a series relationship with the aforementioned elements of the circuit. As an illustration, the closed loop actuators 56, such as a window or door to an enclosure, may be wired to break the circuit upon opening. Likewise, open loop actuators 69, in the identical situation, such as carpet trips may close a circuit and cause the armature 60 of relay 58 to travel from contact 57 and break circuit 10.

Referring again to FIG. 1, it can be seen that opening circuit 10 will deactivate both relay 66 and 68 such that armatures 76 and 84 move from contacts 78 and 88 to contacts 80 and 86. The breaking of circuit 10 then activates any electrical mechanism 106. As shown in FIG. 1, a relay 92 may be interposed between the triggering circuit 10 and electrical mechanism 106. Deactivation of relay 68 completes the circuit between ground 30, armature 16 of relay 12, circuit line 34, coil 94 of relay 92, circuit line 96, armature 84 of relay 68, and power source 28C. Then armature 100 completes the circuit between power source 28D, armature 100, circuit line 90, electrical mechanism 106, and ground 30. Also, armature 100 completes the electrical path from ground 30, armature 16, contact 24, circuit line 34, circuit line 99, diode 98, coil 94, diode 108, circuit line 110, circuit line 91, contact 104, armature 100 to power source 28D. This keeps relay 92 electrically latched even after reactivation of relay 68. Diode 108 prevents current flow from ground 30, through electrical mechanism 106, circuit line 90, circuit line 110 to contact 86 of relay 68, which is connected to power source 28C.

Neither closing the closed loop actuators, or opening the open loop actuators, nor opening switch 50 separately will deactivate the electrical mechanism 106. Repositioning the actuators and opening switch 50 must be completed simultaneously to deactivate the electrical mechanism 106. Alternately, deactivation of the electrical mechanism 106 takes place when reset switch 112 is pressed causing relay 12 to pulse. Armature 16 no longer touches contact 24, thus, breaking the electrical path from ground 30 through contact 24 of relay 12 to coil 94 of relay 92. As can be seen, relay 92 de-energizes electrical mechanism 106.

The circuit 10 possesses the advantage of flexibility and simplicity of operation. As heretofore explained, a plurality of remote switches 38 may be placed simply within the circuit. Mere severing of the circuit line does not compromise the circuit since pulsing of relay 12 depends on the application of a resistance such as afforded by resistor 52 in remote switch means 38.

While in the foregoing specification, embodiments of the invention have been set forth in considerable detail for purposes of making a complete disclosure of the invention, it will be apparent to those skilled in the art that numerous changes may be made in such detail without departing from the spirit and principles of the invention.

What is claimed is:

1. Circuit for triggering an electrical signal for activating an electrically operated mechanism such as an alarm, actuator and the like, having a D.C. current source, comprising:

a. switch means for producing an electrical pulse connected in series with the D.C. current source, b. means for reversing the direction of current flow in said circuit comprising a single-pole, single-throw relay, and a double-pole, double-throw pulse latching relay, both of said relays connected in series with said switch means and each other, such that current flow in one direction in said circuit signifies a closed circuit and current flow in the opposite direction in said circuit signifies that a circuit break will activate the mechanism, and c. means for activating the mechanism upon a circuit break by the generation of an electrical signal comprising a single-pole, double-throw relay biased for greater current flow connected in parallel with said single-pole, single-throw relay.

2. The circuit of claim 1 in which said switch means includes a break switch with a resistor in parallel such that opening of the break switch causes the circuit current to flow through said resistor.

3. The circuit of claim 1 in which said means for reversing the direction of current flow includes a double-pole, double-throw pulse latching relay.

4. The circuit of claim 1 in which said means for activating the mechanism includes a single-pole, double-throw relay providing an electrical signal to an electrically operated mechanism upon a circuit break.

5. The circuit of claim 4 in which the armature of said single-pole, double-throw relay connects to a power source.

6. The circuit of claim 4 in which said switch means includes a break switch with a resistor in parallel such that activation of the circuit breaker causes the circuit current to flow through said resistor which deactivates said single-pole, single-throw relay, said single-pole, double-throw relay remaining active causing an electrical pulse to trip said double-pole, double-throw pulse latching relay and reverse the current flow in said circuit.

7. The circuit of claim 2 in which said switch means includes a parallel pair of light emitting diodes, said pair connected in series with said means for reversing the direction of current flow, said light emitting diodes oppositely oriented such that one of said light emitting diodes illuminates when the current flows in one direction and the other of said light emitting diodes illuminates when the current flows in the other direction.

8. The circuit of claim 2 which additionally comprises a tamper switch connected in series with said break switch.

9. A circuit for producing a signal to an electrically operated alarm and like mechanisms, comprising:

a. double-pole, double-throw pulse latching relay having the first armature of the first set of contacts connected to ground, the second armature of the second set of contacts connected to a power source, the first contact of said second set connected with the second contact of said first set, the first contact of said first set connected with the second contact of said second set, and the first end of coil grounded;

b. switch having a resistor connected in parallel, said switch and resistor connected in series with the second contact of said first set of contacts;

c. single-pole, single-throw relay, the contact of said relay connected in series with the second end of said coil of said double-pole, double-throw relay, and d. single-pole, double-throw relay, the armature of said relay connected to a power source the first contact of said relay connected in series with the armature of said single-pole, single-throw relay, the coil of said single-pole, double-throw relay connected in parallel with the coil of said single-pole, single-throw relay, said single-pole, single-throw relay coil being biased for less current flow than said single-pole, double-throw relay coil, said parallel coils connected in series between said first contact of said first set of said double-pole, double-throw relay and said switch and resistor, the signal to an electrically operated alarm being produced by opening the circuit causing contact of said single-pole, double-throw relay, the alarm connected to said second contact of said single-pole, double-throw relay.

* * * * *